United States Patent [19]

Nakamura et al.

[11] Patent Number: 5,019,862

[45] Date of Patent: May 28, 1991

[54] HEAT CONTROL FOR PHOTORECEPTOR

[75] Inventors: Masatsugu Nakamura; Kunio Ohashi; Shoichi Nagata, all of Nara; Kazuki Wakita, Yao; Katsuhiro Nagayama; Tadashi Tonegawa, both of Nara, all of Japan

[73] Assignee: Sharp Kabushiki Kaisha, Osaka, Japan

[21] Appl. No.: 268,652

[22] Filed: Nov. 8, 1988

Related U.S. Application Data

[63] Continuation of Ser. No. 5,966, Jan. 22, 1987, abandoned.

[30] Foreign Application Priority Data

| | | | |
|---|---|---|---|
| Jan. 23, 1986 | [JP] | Japan | 61-13343 |
| Jan. 23, 1986 | [JP] | Japan | 61-13344 |
| Jan. 23, 1986 | [JP] | Japan | 61-13345 |
| Jan. 27, 1986 | [JP] | Japan | 61-16157 |
| Feb. 18, 1986 | [JP] | Japan | 61-34256 |
| Feb. 18, 1986 | [JP] | Japan | 61-34257 |
| Feb. 18, 1986 | [JP] | Japan | 61-34258 |

[51] Int. Cl.[5] ..... G03G 21/00

[52] U.S. Cl. ..... 355/208; 355/211

[58] Field of Search ..... 355/3 R, 30 R, 14 R, 355/200, 208, 211, 212; 219/216, 471

[56] References Cited

U.S. PATENT DOCUMENTS

| | | | |
|---|---|---|---|
| 2,624,652 | 1/1953 | Carlson | 355/3 X |
| 3,813,516 | 5/1974 | Kudsi et al. | 219/471 |
| 3,825,724 | 7/1974 | Kingsley et al. | 219/471 X |
| 3,833,790 | 9/1974 | Quant et al. | 219/471 X |
| 3,887,367 | 6/1975 | Parker | 430/31 |
| 4,161,357 | 7/1979 | Herman et al. | 219/216 X |
| 4,367,036 | 1/1983 | Sakamaki | 355/14 R |
| 4,585,319 | 4/1986 | Okamoto et al. | 355/200 |
| 4,607,936 | 8/1986 | Miyakawa et al. | 355/3 DR |
| 4,607,937 | 8/1986 | Minami | 355/3 DR X |
| 4,659,206 | 4/1987 | Kai et al. | 355/3 DR |

FOREIGN PATENT DOCUMENTS

| | | | |
|---|---|---|---|
| 60-229054 | 11/1985 | Japan | 355/219 |

*Primary Examiner*—Fred L. Braun

*Attorney, Agent, or Firm*—Flehr, Hohbach, Test, Albritton & Herbert

[57] ABSTRACT

Quality of images formed electrophotographically on a photoreceptor is improved by controllingly switching on and off a heater for the photoreceptor such that the photoreceptor temperature remains higher than the measured ambient temperature by several °C. to 20° plus several °C. At the same time, the output of the charger for the photoreceptor or brightness of an image forming lamp is controlled according to the measured surface temperature of the photoreceptor.

8 Claims, 11 Drawing Sheets

HEAT CONTROL FOR PHOTORECEPTOR

This is a continuation of application Ser. No. 005,966 filed Jan. 22, 1987, now abandoned.

BACKGROUND OF THE INVENTION

This invention relates to devices for improving the quality of electrophotographically formed images. In one aspect, the present invention relates more particularly to an electrophotographic apparatus such as a copying machine capable of producing clear images regardless of changes in the ambient temperature. In another aspect, the present invention relates to a device for controlling the temperature of a photoreceptor such as a photosensitive drum used in electrophotography such that clear images can be obtained consistently.

In an electrophotographic image forming apparatus such as a copying machine, the surface of a photoreceptor such as a photosensitive drum is electrostatically charged in single polarity and is exposed to light. An electrostatic latent image is formed on the surface of the photoreceptor and a visible image is produced therefrom by electrostatic adsorption of developing agent. A corona discharger is used for charging the photoreceptor surface but the resultant surface potential sensitively affects the adsorption characteristics of the developing agent and hence the quality of the image transferred onto a transfer medium such as copy paper. Besides, the surface potential of the photoreceptor is easily affected, for example, by changes in ambient conditions such as temperature. Even if the same current is provided to the corona discharger, therefore, the photoreceptor surface potential is not always raised to the same level. In view of the above, it has been considered to provide a heater by means of which the photoreceptor surface can be maintained at a desired temperature level.

The adsorption characteristics of the photoreceptor surface are also affected by the degradation of the surface conditions of the photoreceptor. After a long period of use, for example, the photoreceptor surface may become dirty and a resultant drop in the surface potential tends to cause reduced image density and non-uniform image formation. For this reason, there have been attempts to vary the current supplied to the charger or the bias voltage applied to the developing tank when the image is developed. If the corona current is increased excessively, however, leaks become likely to develop in the photoreceptor and the effects of ozone may become significant and adversely affect the image quality.

In addition to ozone which oxidizes the photoreceptor surface, compounds generated by corona discharge such as $NO_x$ and $HNO_3$ are generally highly hygroscopic. In a highly humid environment, they absorb moisture in air and gradually degrade the photosensitivity characteristics of the photoreceptor. The photoreceptor therefore becomes incapable of retaining an electrostatic latent image and begins to produce blurry images. A conventional method to prevent this problem has been to provide a heater for the photoreceptor to keep it at a high temperature and thereby prevent it from absorbing moisture. If the photoreceptor, as well as parts and components such as toner and a cleaner blade which are in contact therewith or adjacent thereto, is constantly exposed to a high temperature, however, the image formed thereon becomes dull in the case of a selenium drum because of crystalization and white dots begin to appear in the case of a photoreceptor containing an organic photosensitive material because even small defects become visible in the image.

SUMMARY OF THE INVENTION

In view of the above, it is a general object of the present invention to provide a device for controlling the surface temperature of the photoreceptor used in electrophotography in order to improve the quality of images formed thereon and transferred therefrom.

It is another object of the present invention to provide a device for controlling the surface temperature of a photoreceptor so as to maintain its surface potential at a fixed level.

It is still another object of the present invention to provide a device for controlling the temperature of a photoreceptor to maintain uniform adsorption characteristics of developing agent on the photoreceptor surface.

It is a further object of the present invention to provide a heating device for a photoreceptor which does not increase the adverse effects of ozone and leak current in the photoreceptor.

It is a still further object of the present invention to provide an electrophotographic device capable of producing images of high quality regardless of changes in ambient temperature.

The above and other objects are achieved in one aspect of the present invention by providing a device which comprises a heater for increasing the temperature of a photoreceptor, a temperature detecting means for measuring the temperature of the photoreceptor, a heater controlling means for switching the heater on and off so as to bring the temperature detected by the temperature detecting means to a predetermined level, a potential detecting means for measuring the surface potential of the photoreceptor and memory means for storing the relationship between the surface potential and the surface temperature of the photoreceptor. The aforementioned heater controlling means includes a temperature setting means for determining from the aforementioned relationship stored in the memory means the temperature at which the potential detected by the potential detecting means takes on a predetermined value. With a device thus structured, the temperature which regulates the operation of the heater controlling means can be adjusted such that the surface potential detected by the potential detecting means takes on a set value. When instability develops in the surface potential of the photoreceptor due to deterioration in its surface condition or a change in ambient conditions, therefore, a temperature can be determined at which the desired potential will be detected and the heater controlling means can be operated accordingly.

In another aspect of the present invention, a copying machine is disclosed having a developing device for supplying developing agent to the surface of a photoreceptor, a heater for heating the photoreceptor and a heater controlling means of the type described above. The machine further comprises a leak current detecting means for detecting a leak current through the developing agent in the developing device, memory means for storing the relationship between the leak current and the temperature of the photoreceptor when the image density is kept at a fixed level, and a temperature setting means for determining from the stored relationship a temperature corresponding to the value detected by the leak current detecting means. With a copying machine thus structured, a change in the characteristics of the developing agent in the developing device is detected by the leak current detecting means, a corresponding temperature is determined from the aforementioned stored relationship and the heater is controlled with reference to this temperature. In other words, the surface temperature of the photoreceptor is changed according to the conditions of the developing agent inside the developing device, the surface potential of the photoreceptor being thereby controlled. As a result, the adsorption characteristics of the developing agent to the photoreceptor can be maintained at a fixed level regardless of the general changes of the characteristics of the developing agent and the image density can be stabilized.

According to still another embodiment of the present invention, a heater controlling device for the aforementioned purpose includes means for setting the temperature according to the number of copies made or the length of time taken for the copying when the copying machine is continuously operated. When a large number of copies produced or the copying machine has been operating over an extended period of time and the surface potential of the photoreceptor drops as a result, such a heater controlling device is able to adjust the temperature of the photoreceptors such that its surface potential is restored to the predetermined level. In other words, the drop in the surface potential caused, for example, by the surface degradation of the photoreceptor can be properly compensated for by using the known relationship between the surface potential and the surface temperature of the photoreceptor.

A heater controlling device according to still another embodiment of the present invention causes a test image to be formed on a part of the photoreceptor surface not used for forming a document image. In addition to a heater for the photoreceptor and means for detecting the temperature of the photoreceptor and switching the heater on and off as described in connection with other embodiments of the present invention, this device includes a density detector for measuring test image density, memory means for storing the relationship between the density of a test image and the temperature of the photoreceptor and a temperature setting means for determining the temperature at which the measured test image density takes a predetermined value. With a device of this structure, a test image is formed on the photoreceptor and examined. The density of desired image is adjusted by controlling the surface temperature of the photoreceptor on the basis of the stored relationship between the image density and the temperature of the photoreceptor such that an image of uniformly high quality can be obtained.

In a still further aspect of the present invention, an electrophotographic device includes a sensor for measuring the outside temperature and a heater provided for the photoreceptor is controlled such that the temperature of the photoreceptor remains higher than the measured outside temperature by several degrees (C) to 20 plus several degrees. In addition, the bias voltage on the developer tank used for the development of electrostatic latent image on the photoreceptor surface is varied according to the temperature of the photoreceptor. When the outside temperature is low, the photoreceptor temperature also becomes low with a structure as described above and the charger output can therefore be kept at a low level. Alternatively, means for controlling the light output may be provided so that the photoreceptor is exposed to light correctly depending on its temperature. As a further alternative, means for controlling the charger output directly accordingly to the photoreceptor temperature may be provided.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
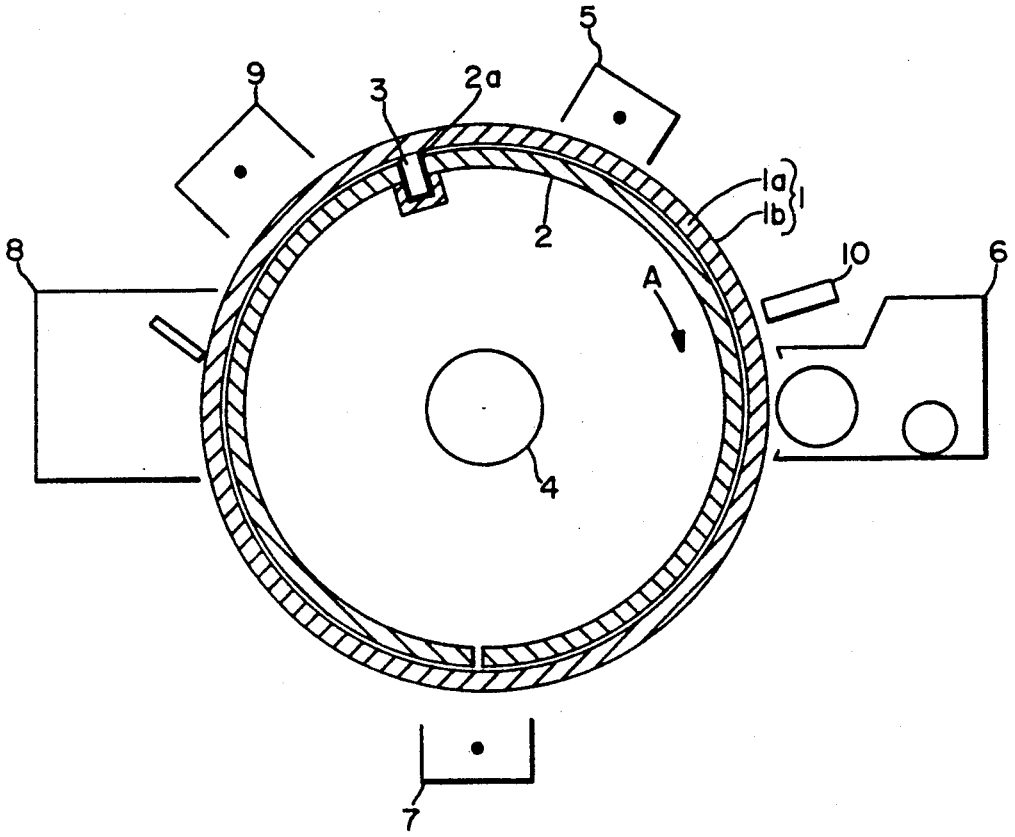
FIG. 1 is a schematic front sectional view of a part of an electrophotographic copying machine including a photosensitive drum and a heater controlling device therefor embodying the present invention.

The main processing section of an electrophotographic image forming apparatus such as a copying machine incorporating a heater controlling device of the present invention is schematically shown in FIG. 1, including a photosensitive drum 1 which is formed with a tubular cylindrical body 1*a* with aluminum as its base material and a photosensitive layer 1*b* of amorphous silicon covering its outer surface. A heater 2 is disposed inside the drum 1 opposite its entire inner surface. This heater 2 is provided with a hole 2*a* inside which is disposed a temperature sensor 3 with its temperature-sensitive part in contact with the inner surface of the drum 1 such that the temperature of the drum 1 is thereby detected. This temperature sensor 3 is herein referred to also as temperature detecting means. The drum 1 is supported by flange means (not shown) rotatably around an axis 4, and is rotated in the direction of the arrow A by a power transmitting means (not shown). The heater 2 is directly affixed to the axis 4 and does not rotate even when the drum 1 rotates. Disposed around the outer periphery of the photosensitive drum 1 are a primary charger 5, a developing device 6, a transfer charger 7, a cleaner 8, and an erase charger 9 which together constitute the processing section of the aforementioned copying machine. An electrometer 10 is disposed above the developing device 6 and serves to measure the potential of the drum surface which is charged in single polarity by a corona discharge of the primary charger 5. The optical system of the copying machine is not included in FIG. 1 for the sake of simplicity.

Figure 2:
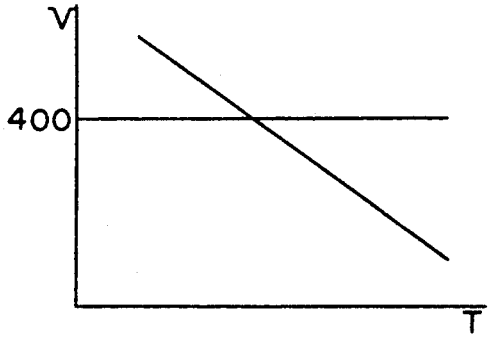
FIG. 2 is a graph schematically showing the relationship between the surface potential and the surface temperature of the photosensitive drum of FIG. 1.

The relationship between the surface temperature T and the surface potential V of the aforementioned photosensitive drum 1 is shown schematically in FIG. 2. The surface potential V of the drum 1 is nearly inversely proportional to the surface temperature. The Figure indicates that best results are obtained with this drum 1 when its surface potential is about 400V.

Figure 3:
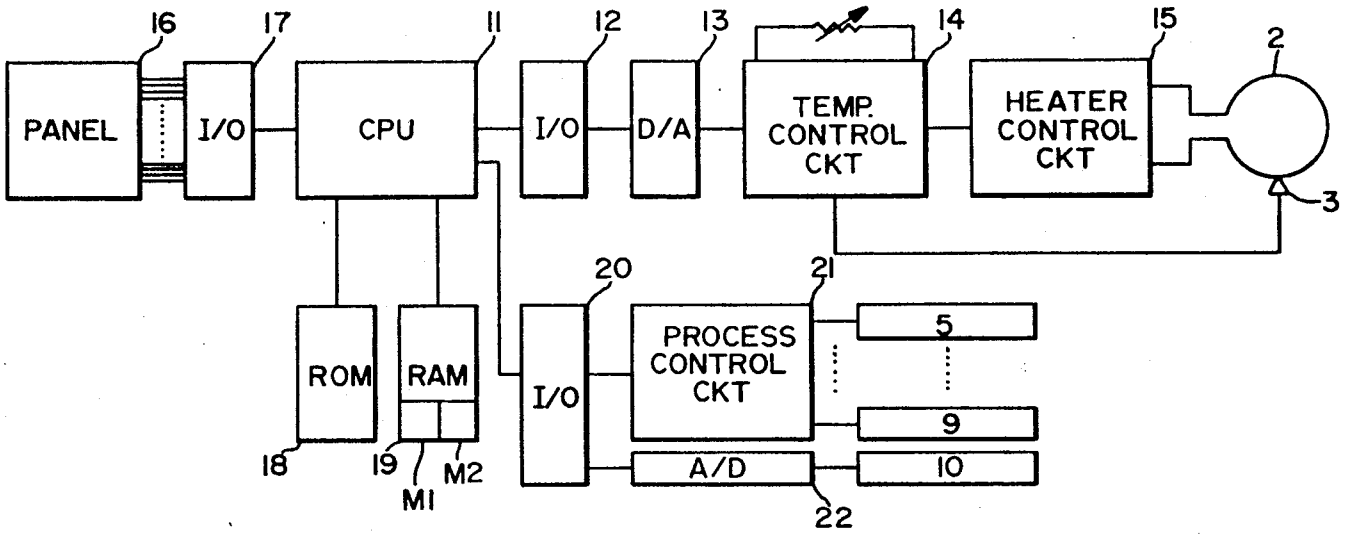
FIG. 3 is a block diagram of the control section of the copying machine of FIG. 1.

FIG. 3 is a block diagram of a control section of the copying machine incorporating the heater controlling device described above. Operation signals are entered into a central processing unit (CPU) 11 from a control panel 16 through an input/output (I/O) interface 17 and signals for controlling the operations of the various devices in the processing section are transmitted to a process control circuit 21 from the CPU 11 through another I/O interface 20. Programs including those for controlling the processing section are stored in a read-only memory (ROM) means 18 connected to the CPU 11 and control signals are transmitted from the interface 20 according to these programs. Output signals from the electrometer 10 are transmitted to the CPU 11 through an analog-to-digital (A/D) converter 22 and the I/0 interface 20.

A temperature value $T_c$ set for the photosensitive drum 1 is transmitted as a digital signal through a still another I/O interface 12 to the digital-to-analog (D/A) converter 13 which converts it into an analog signal and sends it to a temperature control circuit 14. The temperature control circuit 14 also receives a signal from the temperature sensor 3 and after it is compared with the set value $T_c$, a control signal is transmitted to a heater control circuit 15 which serves to switch the heater 2 on and off according to the control signal from the temperature control circuit 14.

A random-access memory (RAM) means 19 is also connected to the CPU 11. A signal indicative of the value measured by the electrometer 10 is stored in binary code in a memory area M1 of the RAM 19. The ROM 18 stores in the form of a table the relationship between the surface potential and the surface temperature of the drum 1. The value stored in the memory area M1 is compared with the reference value of the surface potential (400V in the present example) and a value is read from the ROM 18 corresponding to their difference and is transmitted through the I/O interface 12 as a digital signal.

The operation of the copying machine described above is explained below with reference to the flow chart of FIG. 4. When power is switched on and the system begins to warm up (n1), the surface temperature T of the photosensitive drum 1 is adjusted to the previously set temperature value $T_c$ stored in another memory area M2 in the RAM 19 (n2). This operation is repeated constantly throughout the duration of the copying operation. Next, a counter (I being its content) for recording the repetition number of copying process (or the number of produced copies) is cleared (n3). When the system is completely warmed up (YES in n4), data for copying operation such as the number of copies to be produced, image magnification, the paper size and the document size are either entered from the control panel 16 or calculated internally and set (n5).

Copying is started (n7) if a PRINT switch (not shown) is operated (YES in n6) and the electrometer 10 continues to measure the current value $V_a$ of surface potential (n8). Each time a cycle of copying process is completed, the content of the counter I is increased by 1 (n9). If the measured value $V_a$ of surface potential is found then to be nearly equal to the referenced value $V_c$ (YES in n10), the system goes directly to Step n11. If $V_a$ and $V_c$ are substantially different (NO in n10), the value of $T_c$ is replaced by $T_c - K(V_c - V_a)$ (n13) where K is the slope of the characteristic curve shown in FIG. 2. This closes the heater controlling circuit 15, as explained above, to switch the heater 2 on and off such that the newly set value $T_c$ will be detected by the temperature sensor 3. Accordingly, the surface potential V of the photosensitive drum 1 is adjusted to $V_c$ (=400V). Thereafter, the system examines whether the desired number N of copies has been produced (n11) and either returns to Step n7 or goes through a period of waiting and then returns to Step n1.

In summary, if the surface potential V of the photosensitive drum 1 changes during a copying cycle, it is immediately detected by the electrometer 10 and the system determines by calculation, since the value of K is presumably known and already stored, the new temperature level to which the drum 1 must be raised by operating the heater control circuit 15 so that the surface potential of the drum 1 returns to the original level immediately.

Figure 5:
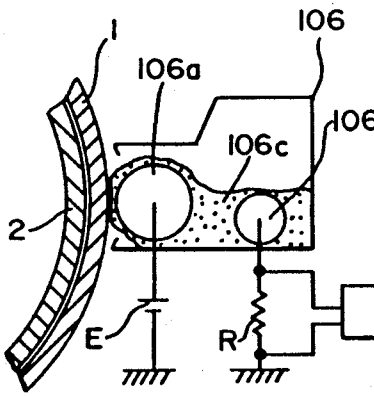
FIG. 5 is a schematic front view of a developing device which is made a part of the processing section of the copying machine according to another embodiment of the present invention.

A copying machine according to another embodiment of the present invention controls its heater not by detecting the surface potential of its photosensitive drum but by measuring the leak current through the developing agent in its developing device. The main processing section of such a machine also appears as shown in FIG. 1 except the electrometer 10 is dispensed with and its developing device appears as shown in FIG. 5 wherein 16 indicates the developing device. With reference now to FIG. 5, the developing device 106, besides containing developing agent 106*c*, supports therein a magnet roller 106*a* and a stirrer roller 106*b* rotatably around their respective axes. A bias voltage E is applied to the magnet roller 106*a* and an electrode is contained in the stirrer roller 106*b* such that an electric current (referred to as the leak current) flows through a resistor R connected to the electrode, the intensity of the current varying according to changes in the resistivity of the developing agent 106*c*. A leak current detecting circuit 110 is connected in parallel with the resistor R to measure the potential drop thereacross and the leak current intensity IL through the developing agent 106*c* is obtained from the result of this measurement.

Figure 6:
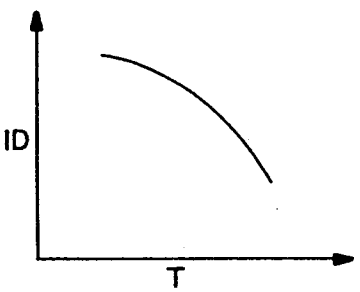
FIG. 6 is a graph schematically showing the relationship between the image density ID on the drum of FIG. 1 and its surface temperature T.
Figure 7:
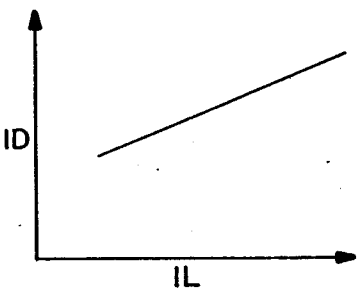
FIG. 7 is a graph schematically showing the relationship between the image density ID on the drum of FIG. 1 and the leak current density IL through the developing agent shown in FIG. 5.
Figure 8:
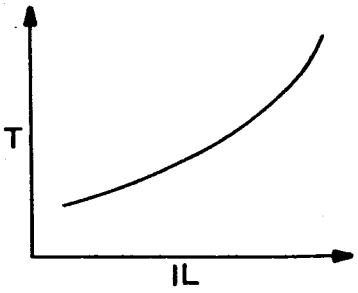
FIG. 8 is a graph schematically showing the relationship between T and IL obtained by combining FIGS. 6 and 7.

On the photosensitive drum 1 (of FIG. 1 and also partially in FIG. 5) with a photosensitive layer of amorphous silicon, the image density ID typically drops as its surface temperature T is increased as shown schematically in FIG. 6. If the leak current intensity IL through the developing agent 106*c* increases, the image density ID on the photosensitive drum 1 also increases as shown schematically in FIG. 7. In order to maintain the image density ID at a constant level, therefore, the surface temperature T of the photosensitive drum 1 must be changed according to the measured leak current intensity IL as shown in FIG. 8 which is obtained by combining FIGS. 6 and 7. FIG. 8 shows that there is nearly a proportionality relationship between T and IL.

The control section of the copying machine characterized above may be described also by way of the block diagram in FIG. 3 except signals indicative of ID are transmitted through the A/D converter 22 and the I/O interface 20 to the CPU 11 (that is, numeral 10 of FIG. 3 should be replaced by 110). In addition, the relationship between T and IL shown in FIG. 8 is stored in the ROM 18 in the form of a table and the result of measurement by the leak current detecting circuit 110 is stored in binary code in the RAM 19. The RAM 19 is used also for temporarily storing various input and output data.

Figure 9:
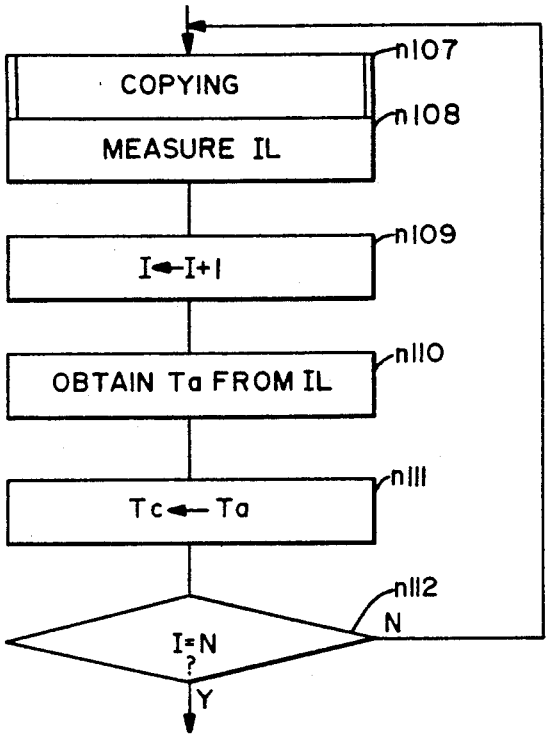
FIG. 9 is a portion of a flow chart for the operation of the copying machine described by way of FIG. 5.

The operation of this copying machine is explained next with reference to the flow chart of FIG. 4 except its portion including Steps n7 through n11 is replaced by Steps n107 through n112 of the flow chart of FIG. 9. Unlike the copying machine of FIG. 1, of which the operation was explained above by way of FIG. 4, this copying machine relies on measured values of IL to improve the quality of images. Throughout the duration of its copying operation (n107 and thereafter) therefore, the leak current detecting circuit continues to measure IC and a temperature value $T_a$ corresponding to IL is obtained (n110) from the table representing the relationship of FIG. 8 and stored in the ROM 18 as explained above. The heater control circuit is operated accordingly and the heater 3 is switched on and off such that $T_a$ will approach the previously set value $T_c$ (n111). Steps n109 and n112 are the same as explained in connection with FIG. 4.

Figure 10:
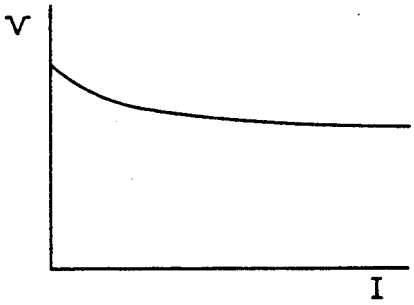
FIG. 10 is a graph schematically showing the drop in the surface potential V of a photosensitive drum as the number of produced copies increases.

A copying machine according to still another embodiment of the present invention controls its heater for the photosensitive drum not by detecting the surface potential of the drum or by measuring the intensity of the leak current through the developing agent but by counting the number of copies which have been made. As shown in FIG. 10, the surface potential V of the photosensitive drum 1 changes as the number of copies made (identified above as the number counted by the counter I) increases, dropping rapidly in the beginning and more gradually later. The relationship between the surface potential V of the photosensitive drum and its surface temperature T has already been described by FIG. 2. Thus, the relationship between I and T can be easily established.

The processing section of such a copying machine may look also as schematically shown in FIG. 1 with the electrometer 10 again dispensed with and its control section may be represented by the same block diagram as shown in FIG. 3 without the electrometer 10 and the A/D converter 22. An area in the RAM 19 connected to the CPU 11 is reserved for storing I (the number of copies which have been produced as defined above). Whenever I reaches a redefined value, a preset temperature value is read from the ROM 18 and transmitted as a digital signal through the I/O interface 12.

Figure 4:
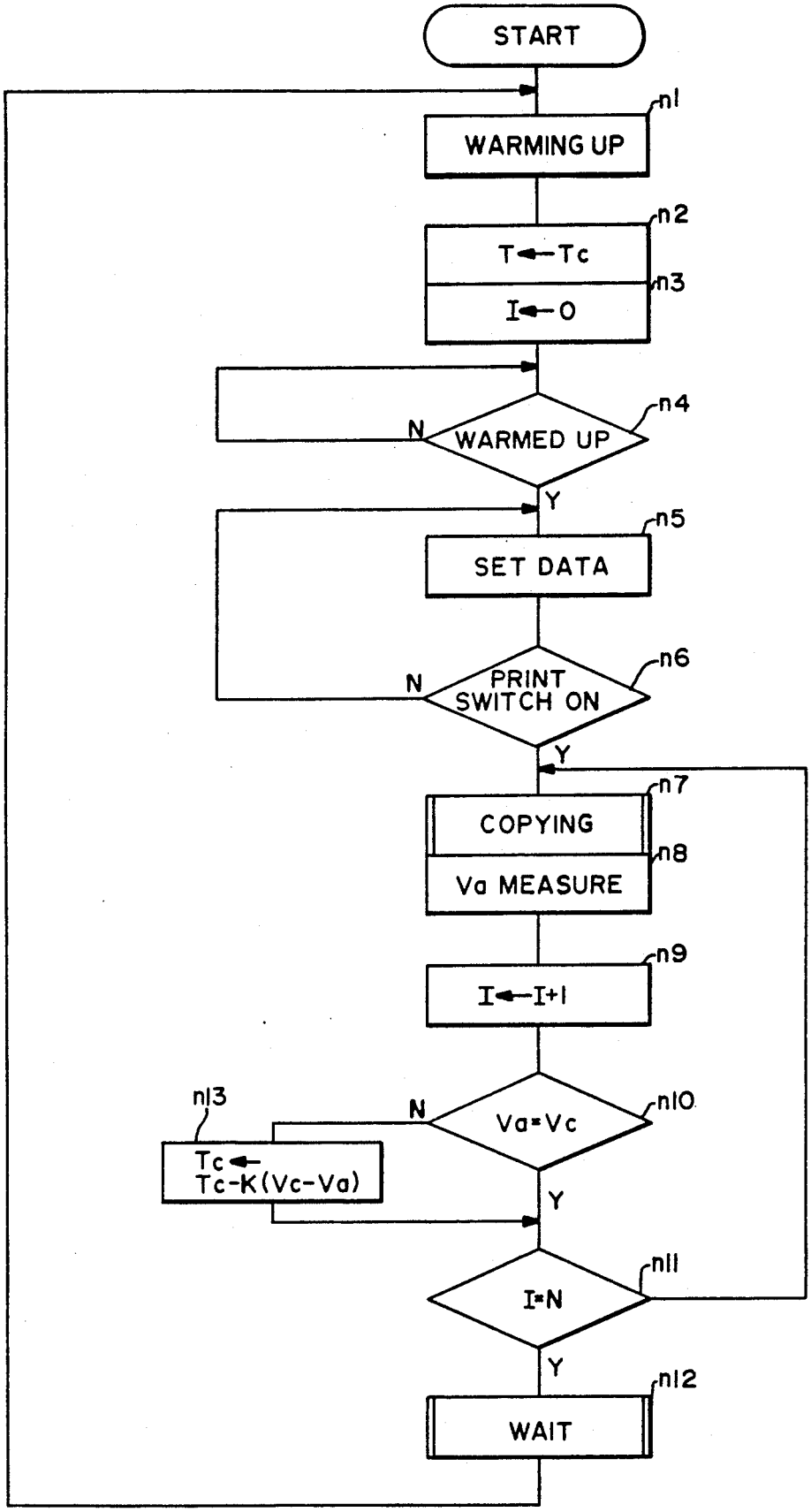
FIG. 4 is a flow chart for the operation of the copying machine shown in FIGS. 1 and 3.
Figure 11:
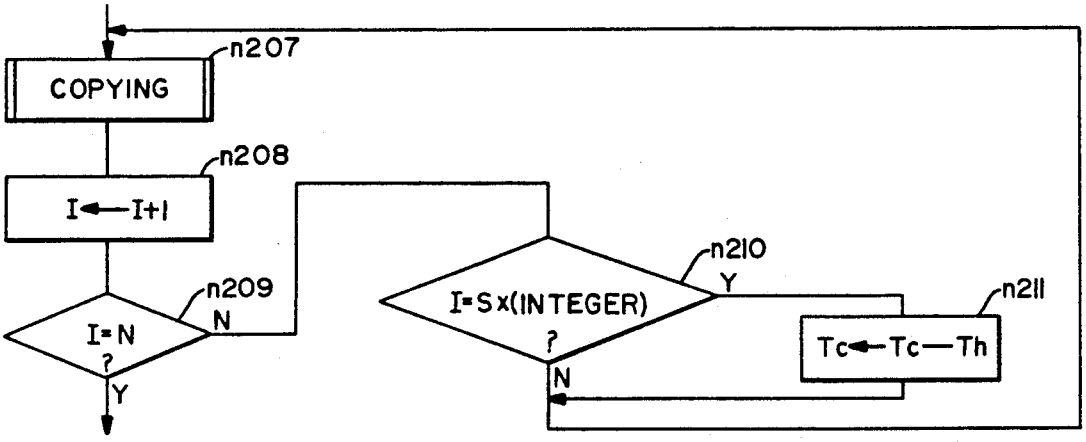
FIG. 11 is a portion of a flow chart for the operation of another copying machine embodying the present invention.
Figure 12:
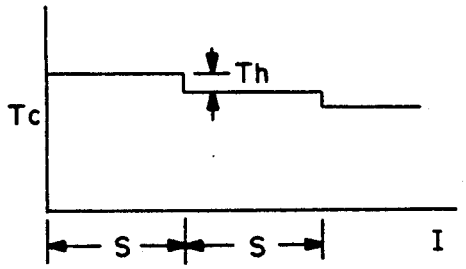
FIG. 12 is a graph showing how the set temperature value $T_c$ is changed according to the method of operation of a copying machine depicted by the flow chart of FIG. 11.

The operation described above may be represented by a flow chart obtained from that of FIG. 4 with Step n2 deleted and the portion from Step n7 to Step n11 replaced by the segment shown in FIG. 11 including Step n207 through Step n211. With reference to the flow chart thus obtained, the control section of the copying machine according to this embodiment of the present invention keeps track of the number of copies produced (n208) throughout the duration of a copying process (n207). If I reaches a preset number N, the system returns to Step n1 after a waiting period (n12). If a very large number of copies are to be produced such that N is greater than another preset number S or some integral multiple of S, the temperature value $T_c$ initially set for the photosensitive drum is reduced by a predetermined amount $T_h$ whenever I is found to equal an integral multiple of S (as shown in FIG. 12).

Figure 13:
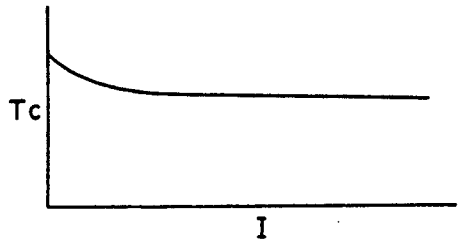
FIG. 13 is a graph schematically showing how $T_c$ is changed as a function of the number of copies produced according to an alternative method of operation.

In short, the temperature of the photosensitive drum is controlled by changing the set temperature value $T_c$ every time a present number S of copies are made. Alternatively, $T_c$ may be varied as a function of I as shown in FIG. 13 which is obtained, as explained above, by considering FIGS. 2 and 10 together. As a further alternative, a timer may be provided and the temperature value $T_c$ may be varied as a function of the time elapsed from the beginning of a copying process.

Figure 14:
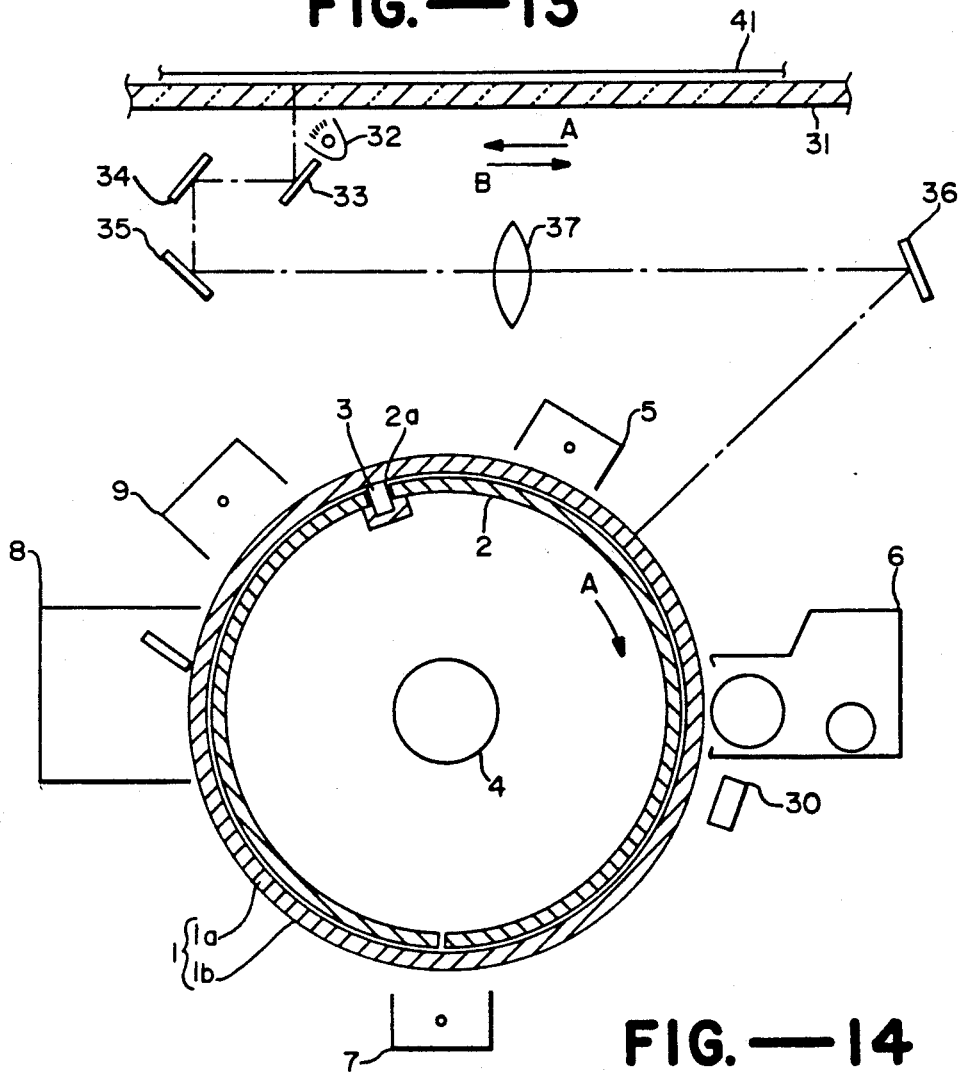
FIG. 14 is a schematic front sectional view of a part of a copying machine according to still another embodiment of the present invention.

According to still another embodiment of the present invention, a heater controlling device operates according to the image density of a test pattern FIG. 14 is a front sectional view of the processing section of a copying machine with such a heater controlling device. For the sake of convenience, its optical unit is also shown in FIG. 14. Components which are identical to those shown in FIG. 1 are indicated by the same numerals as defined above.

The copying machine of FIG. 14 is characterized, in contrast to those described above, as having a photo-sensor 30 below the developing device 6. A document table 31 of transparent hard glass is disposed on the top surface of the housing (not shown) to place thereon a document 41 to be copied. Below the document table 31 is a scanner which includes a light source 32 and mirrors 33–35 and is adapted to move reciprocatingly in the direction of arrows A and B. Numeral 37 indicates a lens and numeral 36 indicates a fixed mirror such that the reflected light of the source 32 from the document 41 is made incident on the surface of the photosensitive drum 1 during a copying process. The electrostatic latent image thus formed is converted into a visible image as explained above.

Figure 15:
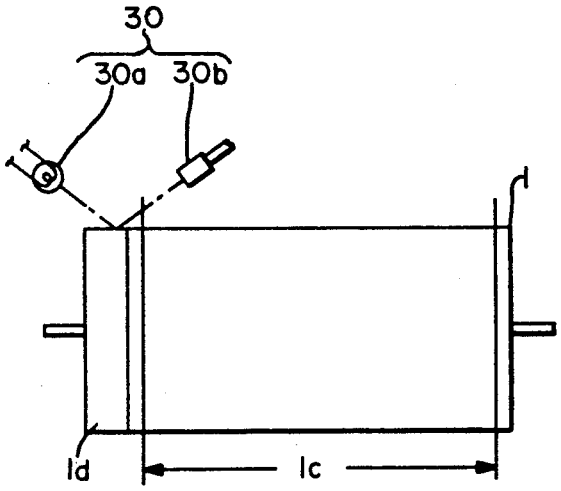
FIG. 15 is a schematic bottom view of the photosensitive drum of FIG. 14.
Figure 16:
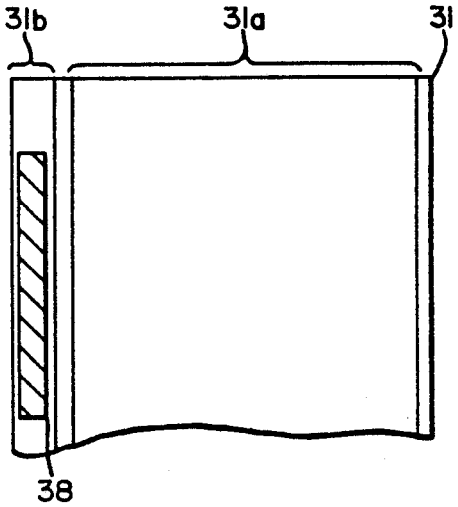
FIG. 16 is a schematic bottom view of the document table of FIG. 14.

With reference to FIG. 15 which is a schematic bottom view of the photosensitive drum 1 of the FIG. 14 it is to be noted that the drum 1 is made somewhat wider in its axial direction than the width 1*c* of the area for forming the image of the document 41 and that there is defined an end area 1*d* adjacent to one of its peripheral edges and external to the aforementioned image-forming area 1*c*. With reference to FIG. 16 which is a schematic bottom view of the document table 31 of FIG. 14, the document table 31 according to this embodiment of the present invention is also characterized as being wider than the width 31*a* (which matches the width 1*c*) of the area intended for placing thereon the document 41 to be copied. A test pattern 38 is formed in the edge area 31*b* (outside the document carrying area represented by the width 31*a*) which corresponds to the end area 1*d* of the drum 1. During a copying process, light from the source 32 is also made incident on this test pattern 38 and the reflected light therefrom forms an image in the end area 1*d* of the drum 1. This latent image of the test pattern 38 is also made visible by the developing device 6.

Figure 17:
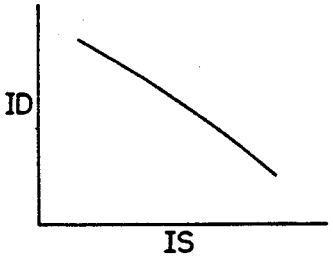
FIG. 17 is a graph schematically showing the relationship between the image density ID of a test pattern and the output IS from a photo-sensor which detects it.

The photo-sensor 30, which is identified herein also as the density detecting device, is comprised of a light emitting element 30*a* and a light receiving element 30*b*. The light emitting element 30*a* is adapted to irradiate the end area 1*d* and the reflected light therefrom is received by the light receiving element 30*b*. The photo-sensor 30, being disposed below the developing device 6, is adapted to detect the light reflected by a developed visible image of the test pattern 38. Thus, the detected value IS by the photo-sensor 30 is low when the image density ID of the test pattern 38 is high and the detected value IS is high when the image density ID is low. This is schematically shown in the graph of FIG. 17.

Figure 18:
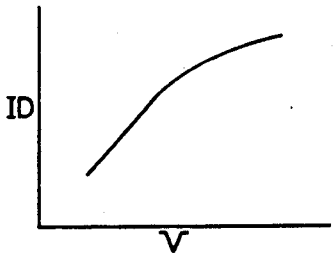
FIG. 18 is a graph schematically showing the relationship between the image density ID considered in connection with FIG. 17 and the surface potential V of the photosensitive drum of FIG. 14.
Figure 19:
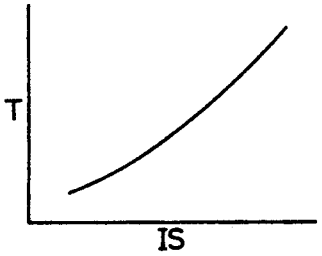
FIG. 19 is a graph schematically showing the relationship between the surface temperature T of the photosensitive drum of FIG. 14 and the output IS considered in connection with FIG. 17.

The surface temperature T and the surface potential V of the photosensitive drum 1 with amorphous silicon layer 1*b* of FIG. 14 are related as shown in FIG. 2. The image density ID on the drum surface increases with the surface potential V as shown in FIG. 18. Thus, it can be established that the output IS from the photo-sensor 30 is related to the surface temperature T of the photosensitive drum 1 as shown in FIG. 19, that is, the output IS from the photo-sensor 30 increases with the surface temperature T.

The control unit of the copying machine described above by way of FIGS. 14–19 is structured as shown by the block diagram of FIG. 3 except the output from the photo-sensor 30 (rather than the electrometer 10 of FIG. 1) is transmitted to the CPU 11 through the A/D converter 22 and the I/O interface 20. The RAM 19 has an area for storing a specified temperature value Tc as explained in connection with another embodiment of the present invention and the ROM 18 stores, in addition to the program for controlling the copying process, the relationship between T and IS shown by the graph of FIG. 19.

Figure 20:
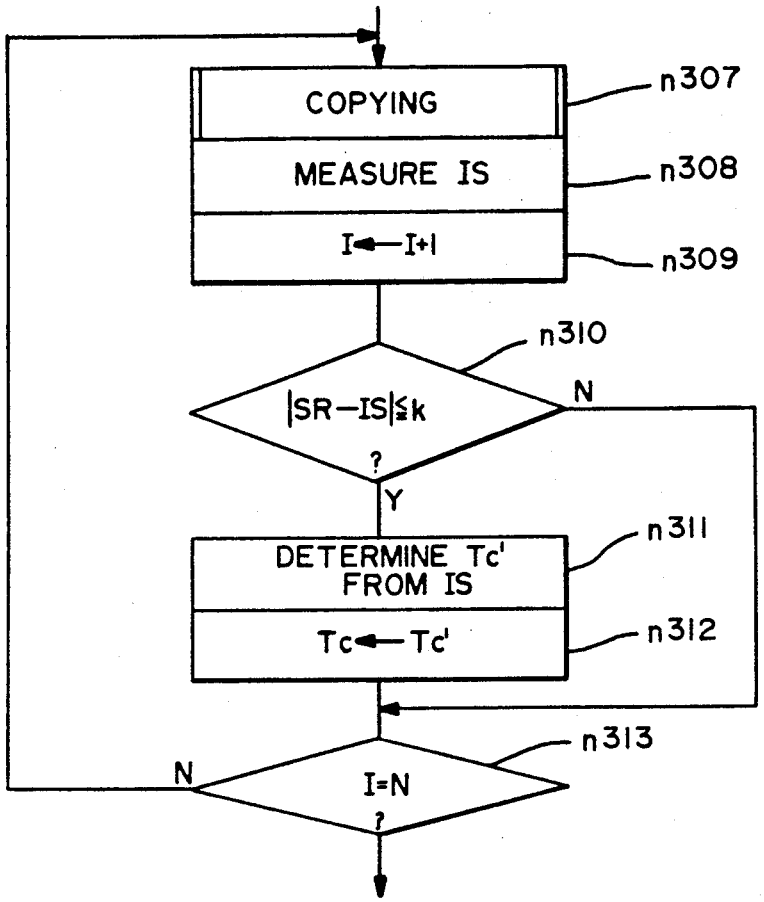
FIG. 20 is a portion of a flow chart showing the operation of the copying machine described by way of FIGS. 14–19.

Operation by this operating unit is explained next by way of the flow chart of FIG. 4 with its portion from Step n7 through Step n11 replaced by the chart shown in FIG. 20. With reference, therefore, to both FIG. 4 and FIG. 20, the copying machine according to this embodiment of the present invention continues throughout its copying process (n307) to record the output IS from the photosensor 30 measuring the image density of the test sample 38. A reference output value SR is predetermined and if the absolute value of the difference between the measured output IS from the photo-sensor 30 and this reference value SR is larger than a predefined value k (YES in n310), the system determines from FIG. 19, or the relationship between T and IS stored in the ROM 18, a new temperature value $T_c'$ prime corresponding to the measured value IS (n311) and replaces $T_c$ stored in the RAM 19 by this newly determined value $T_c'$ (n312). If the aforementioned absolute value is less than the predefined value k (NO in n310), the system keeps $T_c$ as the set temperature value according to which the heater is switched on and off. Steps n309 and n313 are the same as explained in connection with FIG. 4.

Figure 21:
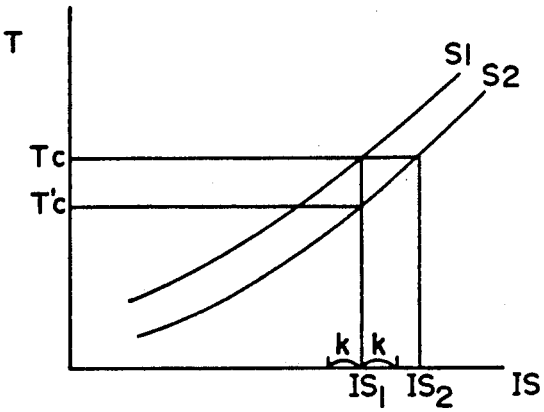
FIG. 21 is a graph schematically showing a procedure for operating a heater controlling device according to the flow chart of FIGS. 4 and 20.

Let us assume, for the sake of explanation, that T and IS are related as shown by the curve $S_1$ of FIG. 21 and that $IS=IS_1$ under the ideal copying condition. Initially, therefore, the reference temperature value $T_c$ is selected from the curve $S_1$ corresponding to this reference value $IS_1$ and the heater controlling device operates to maintain the surface temperature of the photosensitive drum at $T_c$. Thereafter, if the output of the photo-sensor 30 changes to $IS_2$ such that the absolute value of the difference between $IS_1$ and $IS_2$ is greater than a certain predefined value k, another curve $S_2$ is drawn parallel to the curve $S_1$ such that $IS=IS_2$ when $T=T_c$ on $S_2$. If $T=T_c'$ corresponds to $IS_1$ on $S_2$, and if the heater is controlled such that the surface temperature T of the drum is maintained at $T_c'$ thus determined, the output of the photo-sensor 30 should change back to $IS_1$. The heater controlling device is accordingly operated to keep the surface temperature T at the newly determined value $T_c'$.

Alternatively, the control section may be so programmed that the test pattern 38 is scanned only before the copying is started. In order to prevent any significant change in the condition of image formation, a timer may be used to repeat the scanning of the test pattern 38 regularly at a predetermined time interval.

Figure 22:
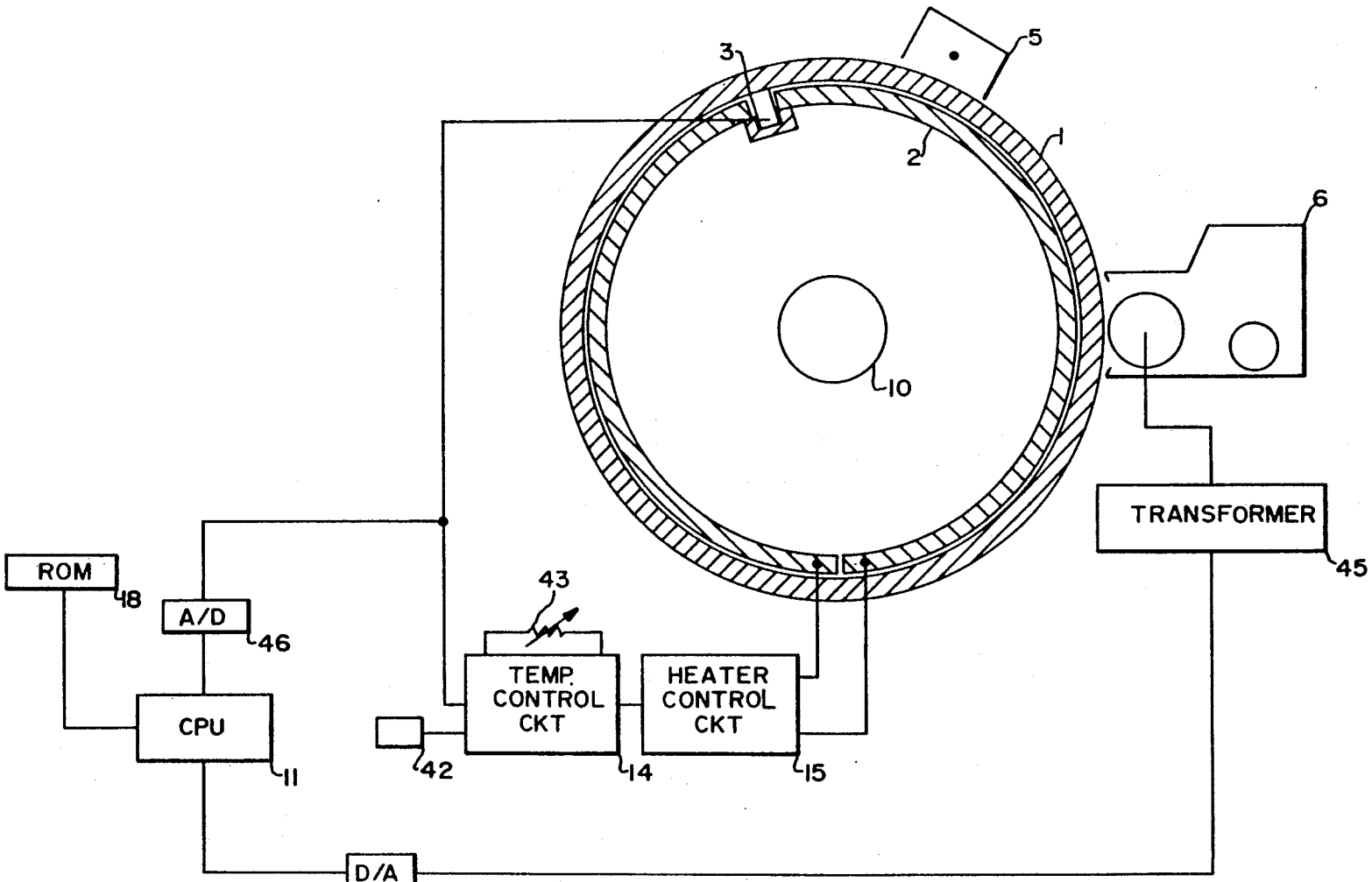
FIG. 22 is a schematic diagram showing another control unit copying machine embodying the present invention.

Another method of obtaining images of high quality regardless of changes in ambient temperature has been to control the output of the primary corona charger to maintain the surface potential of the photoreceptor according to its surface temperature. According to such a method, however, the charger output must be increased when temperature is high and this causes an increase in the generation of ozone and stress on the photosensitive film, producing dull images due to surface oxidation and crystalization. Appearance of white dots is also accelerated on the images. When the temperature of the photoreceptor becomes high, furthermore, its charging characteristics may be adversely affected and its photosensitivity may increase. As a result, bright copies with low density are sometimes obtained. Since the residual potential increases when temperature becomes low, images with the so-called fog are also sometimes obtained. FIG. 22 shows schematically a control unit of another copying machine of the present invention which allows images of high quality to be produced in spite of changes in ambient temperature. Components which are identical or equivalent to those explained with reference to FIGS. 1 and 3 are indicated by the same numerals except what was referred to as the "temperature sensor 3" in FIG. 1 is hereinafter referred to as the first thermister (Rt1) 3 because there is also provided a second thermister (Rt2) 42 which is appropriately placed for measuring ambient temperature. Components not requiring any explanation in particular are not included for the sake of simplicity.

With reference still to FIG. 22, the heater control circuit 15 is connected to the heater 2 and the temperature control circuit 14 is programmed to transmit a control signal to the heater control circuit 15 such that the heater 2 is operated so as to maintain a temperature difference of about 10° C. between the two thermisters 3 and 42. Numeral 43 indicates a veractor VR for adjusting this temperature difference. Numeral 45 indicates a bias transformer for applying a bias voltage to the developing device 6 to control the amount of toner which becomes attached to the surface of the photosensitive drum 1.

The CPU 11 receives through an A/D converter 46 a signal indicative of the temperature of the drum measured by the first thermister 3. Data necessary to calculate the bias voltage to be applied by the transformer 45 according to the temperature of the photosensitive drum 1 are stored in the ROM 18. The CPU 11 operates to transmit through a D/A converter 47 to the transformer 45 a signal indicative of the bias voltage to be applied to the developing device 6 according to the information received from the A/D converter 46 and the data stored in the ROM 18. An optimum bias voltage is thus applied to the developing device 6.

Figure 23:
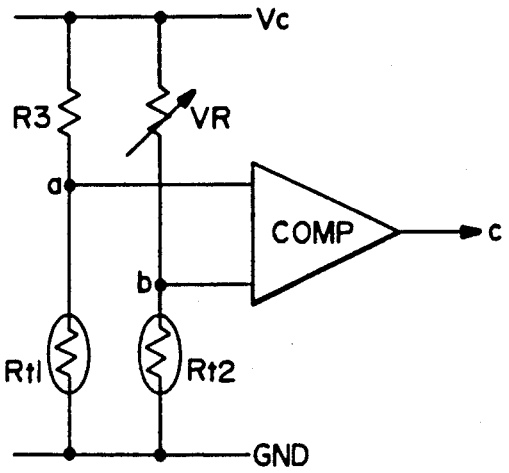
FIG. 23 is a circuit diagram of the temperature control circuit used in the control unit shown in FIG. 22.

FIG. 23 is a circuit diagram of the temperature control circuit 14 wherein COMP indicates a comparator which compares potential at point a with the potential at point b. Its output potential (at point c) is "H" if the potential at point a is higher and "L" if the potential at point b is higher. The heater control circuit 15 operates to switch on the heater 2 when the potential at point c is "H", thereby controlling the heater 2 in such a way that the potential becomes equal at points a and b. Veractor VR is so designed that the potential at points a and b can be adjusted to become equal when the temperature of the photosensitive drum is higher than the ambient temperature by 10° C.–15° C., that is, the output potential of the comparator COMP is "H" when the temperature difference exceeds 10° C. if the veractor VR has the smallest resistance and the output potential of the comparator COMP is "L" when the temperature difference exceeds 15° C. if the veractor VR is set at its highest resistance. The temperature difference can thus be set within the range of 10° C.–15° C.

Table 1 shows the changes in the quality of copies made by a copying machine of this type when the difference between the temperature of the photosensitive drum 1 and the ambient temperature is 5° C., 10° C., 25° C. and 35° C. It is seen that white dots begin to appear and toner begins to harden if this temperature difference exceeds 35° C. In such a case, the quality of copies is very bad and the number of copies that can be made decreases rapidly. If the temperature difference is 5° C., on the other hand, the results are generally good except for the fog. It may be concluded from this observation that good results are obtained when the temperature difference is in the range or several ° C to 20 plus several ° C. is between about 5° C. and about 27° C. If this temperature difference is 10° C., for example, the drum temperature will be controlled to be 20° C. when the ambient temperature is as low as 10° C. Since conventional copying machines designed to keep the drum temperature at a constant level generally keep it at a temperature as high as about 40° C., it is understood that the drum temperature is kept at a much lower level according to the present invention. If the drum temperature is low, the output of the primary corona charger can also be kept low and the stress on the photosensitive drum can be reduced significantly. Moreover, temperature stress on the developing agent, the cleaner blade, etc. can be reduced and hence their lifetimes can be improved.

TABLE 1

| Temperature Difference | Fog | White Dots | Hardening Toner | Unclear Image | Maximum Copies |
|---|---|---|---|---|---|
| 35° C. | A | C | C | A | 60K |
| 25° C. | A | B | B | A | 280K |
| 10° C. | B | B | A | B | 400K |
| 5° C. | C | A | A | B | 360K |

Note:
A = Excellent
B = Good
C = Not Good

Figure 24:
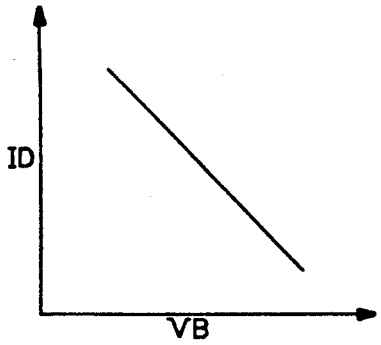
FIG. 24 is a graph schematically showing the relationship between the image density ID and the bias potential VB applied to the developing tank shown in FIG. 22.
Figure 25:
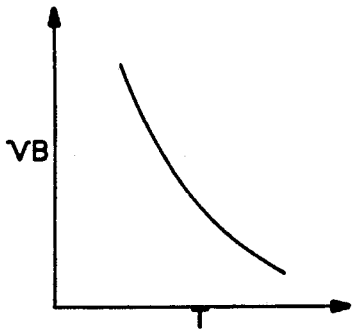
FIG. 25 is a graph showing the bias potential VB to be applied to the developing tank of FIG. 22 in order to maintain the image density at a uniform level when the surface temperature of the photoreceptor is T.

Photosensitive materials used in electrophotography such as Se, $As_2Se_3$, amorphous silicon, CdS, ZnO and OPC have all similar temperature characteristics. As a typical example, since the surface potential V of a photoreceptor drops if its surface temperature T increases, the image density ID thereon also drops. Since the relationship between the image density ID and the bias potential VB applied to the developing tank is as shown in FIG. 24, uniform image density ID can be obtained if the bias potential VB is varied according to the surface temperature T of the photoreceptor as shown in FIG. 25. The relationship shown in FIG. 25 is stored in the ROM 18 of FIG. 22 either as a functional relationship or in the form of a table such that the optimum bias potential to be applied to the developing tank according to the drum temperature can be determined. Alternatively, the ROM 18 may store data related to the relationships between ID and T and between ID and VB.

Figure 26:
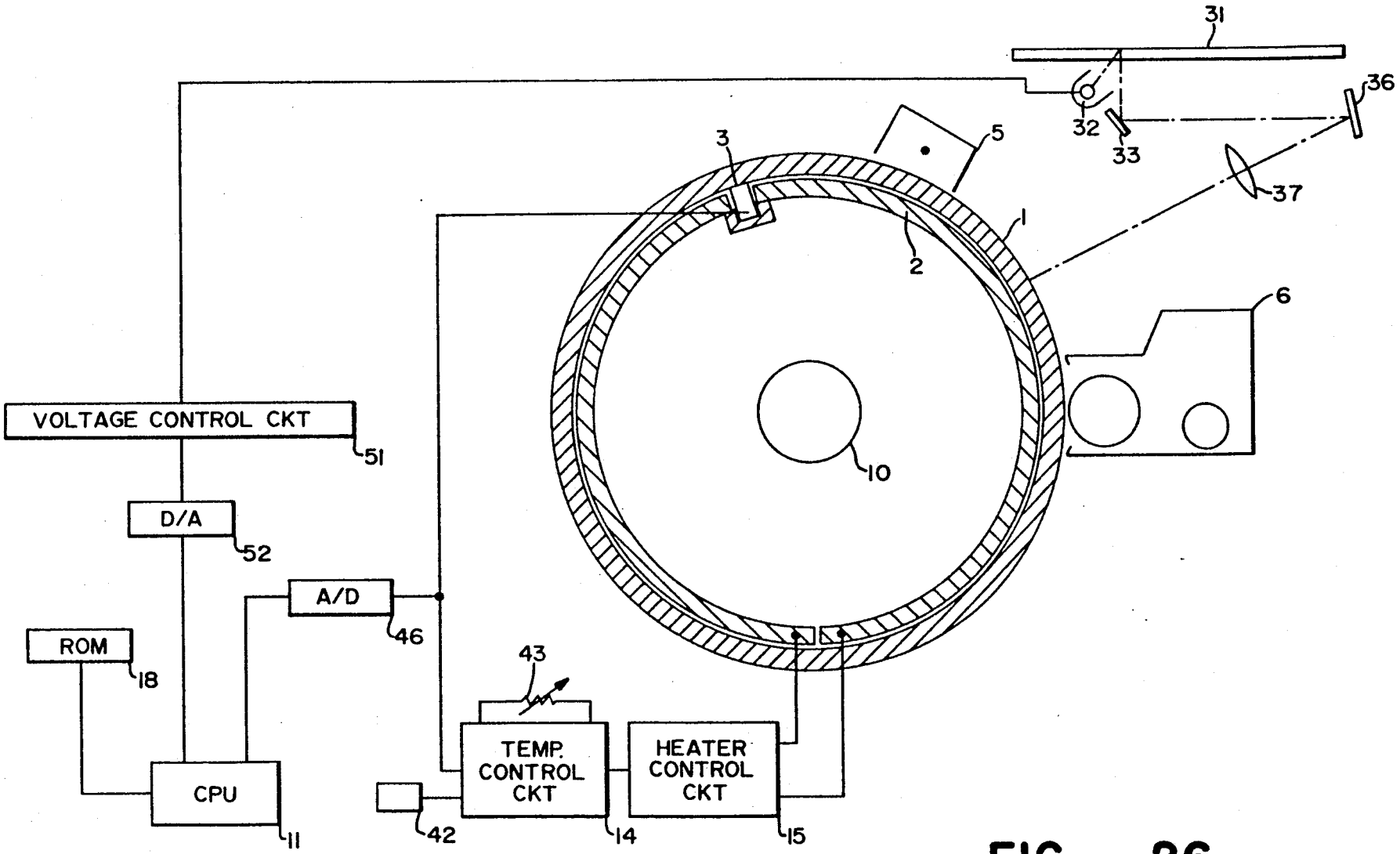
FIG. 26 is a schematic diagram showing a part of still another copying machine and its control unit embodying the present invention.

A part of a copying machine according to another embodiment of the present invention together with its control unit is shown in FIG. 26 wherein components which are identical or equivalent to those already explained above in connection the FIGS. 1, 3, 14 and 22 are indicated by the same numerals and those not requiring any special explanation in particular are not included for the sake of simplicity. The copying machine depicted in FIG. 26 is characterized as having a voltage controlling circuit 51 so connected as to control the voltage VL applied to the light source (also referred to as copy lamp) 32 in response to a signal received from the CPU 11 through a D/A converter 52 and to thereby control its brightness.

Figure 27:
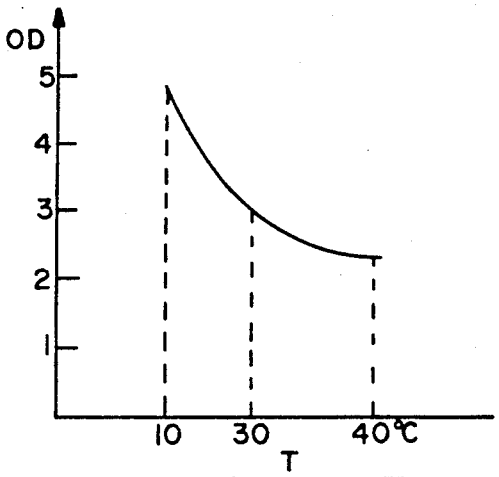
FIG. 27 is a graph schematically showing the relationship between optimum dial setting and the drum temperature T.
Figure 28:
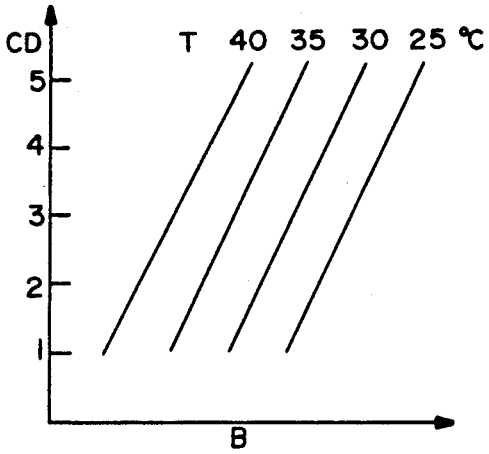
FIG. 28 is a graph schematically showing how the voltage applied to the lamp of the copying machine of FIG. 26 should be varied to give an optimum exposure.

In general, photosensitivity of a material for photoreceptor increases and the images formed thereon becomes brighter when its temperature rises. This is depicted schematically in FIG. 27 in terms, for example, of the relationship between the temperature T of the photosensitive drum 1 and the optimum dial setting OD for exposure by the lamp 32. When the drum temperature T is 30° C., for example, the optimum exposure results if a control dial CD is set to 3. If the drum temperature T changes, however, the dial setting which would result in optimum exposure also changes. Manual adjustments of dial setting are cumbersome while automatic adjustments involve problems. According to the present invention, the relationship as shown in FIG. 28 between the dial setting or range in which the voltage to be applied to the lamp 32 may be optimally varied and its brightness B is stored in the ROM 18 for selected values of the drum temperature T. With a control unit thus structured, the drum temperature T can be maintained higher than the ambient temperature by several ° C. to 20 plus several ° C. and the voltage applied to the lamp 32 can be adjusted optimally according to the drum temperature T.

Figure 29:
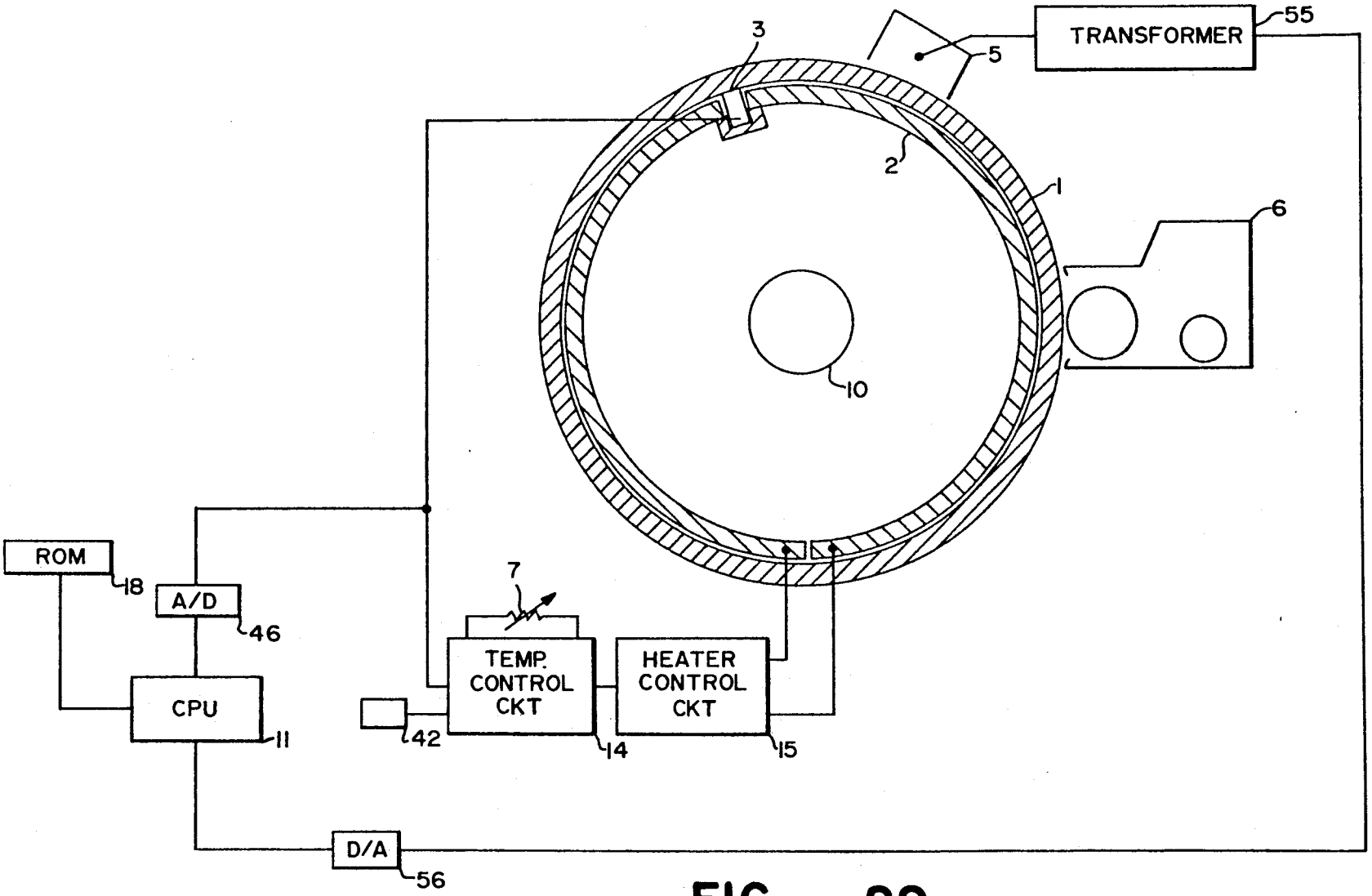
FIG. 29 is a schematic diagram showing a part of still another copying machine and its control unit embodying the present invention.

A part of a copying machine according to still another embodiment of the present invention together with its control unit is shown schematically in FIG. 29 wherein components which are identical or equivalent to those already explained above in connection with FIGS. 1 and 22 are indicated by the same numerals and those not requiring any special explanations in particular are not included for the sake of simplicity. The copying machine depicted in FIG. 29 is characterized as having a high voltage transformer 55 connected to the primary charger 5 to control its discharge current according to an output signal transmitted from the CPU 11 through another D/A converter 56. The CPU 11 receives signals indicative of the temperature of the photosensitive drum 1 from the first thermister 3 through the A/D converter 46. Data for determining an optimum voltage to be applied to the primary charger 5 corresponding to the drum temperature T are stored in the ROM 18 as will be described more in detail below. The CPU 11 serves to transmit the aforementioned output signal on the basis of the temperature signal received from the first thermister 3 and the data stored in the ROM 18.

Figure 30:
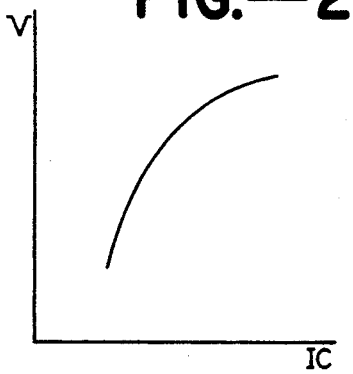
FIG. 30 is a graph schematically showing the relationship between the surface potential V of a photosensitive drum and the output current of its charger.
Figure 31:
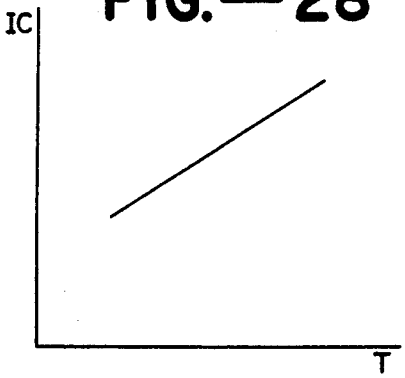
FIG. 31 is a graph schematically showing the charger current output which should be applied to the photosensitive drum of FIG. 29 in order to maintain its surface potential at a fixed level.

As the drum temperature T rises, ability of its photosensitive layer to be charged is adversely affected and its surface potential V drops as shown in FIG. 2. On the other hand, the surface potential V can be increased by increasing the charger current output IC as shown in FIG. 30. Thus, the charger current output IC must be changed as shown in FIG. 31 according to the drum temperature T in order to maintain its surface potential V at a fixed level and thereby form images of uniformly good quality. The relationship between IC and T depicted in FIG. 31 may be stored in the ROM 18 either as a functional relationship or in the form of a table. Alternatively, the ROM 18 may store data related to the relationships between V and T and between V and IC. With the copying machine thus controlled, the drum 1 can be properly charged according to its temperature by setting it higher than its ambient temperature by several ° C. to 20 plus several ° C.

Figure 32:
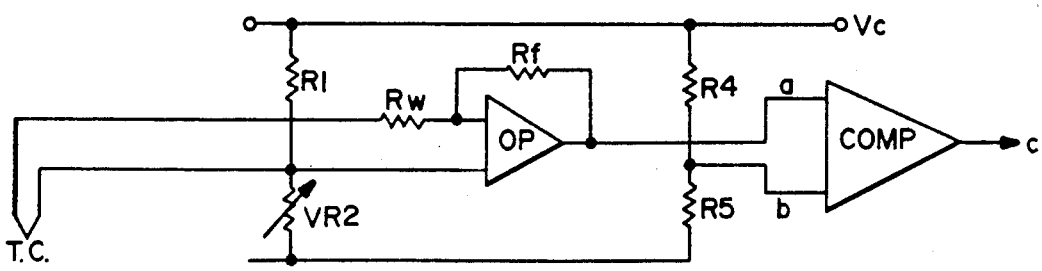
FIG. 32 is another circuit diagram of the temperature control circuit shown in FIGS. 22, 26 and 29.

The temperature control circuit 14 shown in FIGS. 22, 26 and 29 may be formed alternatively by using a thermocouple TC with reference to room temperature as shown in FIG. 32 instead of the thermister of FIG. 23. With reference to FIG. 32, an amplifier OP serves to amplify output signals from the thermocouple TC and the comparator COMP, as in FIG. 23, serves to compare the potential at points a and b. The veractor VR2 serves to set the difference between the drum temperature and the ambient temperature as explained above in connection with FIG. 23.

The foregoing description of preferred embodiment of the invention has been presented for purposes of illustration and description. It is not intended to be exhaustive or to limit the invention to the precise form disclosed. Any modifications and variations which may be obvious to a person skilled in the art are intended to be included within the scope of this invention.

What is claimed is:

1. In a photoreceptor heater controlling device comprising a heater for heating a photoreceptor, a temperature detecting means for measuring the temperature of said photoreceptor, and a heater controlling means for switching said heater on and off such that the measured temperature by said temperature detecting means is adjusted to a preset target temperature value, the improvement wherein said photoreceptor heater controlling device further comprises a potential detecting means for measuring surface potential of said photoreceptor, and memory means storing the relationship between surface potential and surface temperature of said photoreceptor, said heater controlling means including a temperature setting means for identifying from said relationship a corresponding temperature value at which the value measured by said potential detecting means is a predetermined potential value and setting said corresponding temperature value as said target temperature value.

2. In a copying apparatus comprising a developing device for supplying developing agent to the surface of a photoreceptor, a heater for heating said photoreceptor, and a heater controlling means for switching said heater on and off such that the temperature of said photoreceptor is adjusted to a preset target temperature value, the improvement wherein said copying apparatus further comprises current detecting means for measuring leak current through developing agent inside said developing device, memory means storing the relationship between said leak current and temperature of said photoreceptor when image density on said photoreceptor is held fixed, and temperature setting means for identifying from said relationship a temperature value corresponding to leak current value measured by said current detecting means and setting said corresponding temperature value as said target temperature value.

3. In a photoreceptor heater controlling device comprising a heater for heating a photoreceptor, a temperature detecting means for measuring the temperature of said photoreceptor, and a heater controlling means for switching said heater on and off such that the temperature of said photoreceptor is adjusted to a preset target temperature value, the improvement wherein said heater controlling means include one of the following groups of means:

(i) counter means for counting the number of copies produced continuously by said photoreceptor and control means for controlling said target temperature value according to the number counted by said counter means, and timer means for measuring the time of continuously operating said photoreceptor and control means for controlling said target temperature value according to the time measured by said timer means, such that the surface potential of said photoreceptor is adjusted to a preset potential level.

4. The photoreceptor heater controlling device of claim 3 further comprising memory means storing a preestablished functional relationship between the number of copies produced continuously by said photoreceptor and the surface temperature of said photoreceptor.

5. In a photoreceptor heater controlling device comprising a heater for heating a photoreceptor, a temperature detecting means for measuring the temperature of said photoreceptor, and heater controlling means for switching said heater on and off such that the temperature of said photoreceptor is adjusted to a preset target temperature value, the improvement wherein said photoreceptor heater controlling device further comprises test image forming means for forming a test image outside an area for forming document image on said photoreceptor, density detecting means for measuring the image density of said test image, memory means storing the relationship between test image density and the temperature of said photoreceptor, and temperature setting means for obtaining from said stored relationship a temperature value at which said density detecting means detects a predetermined standard value and setting said obtained temperature value as said target temperature value.

6. In an electrophotographic apparatus comprising a photosensitive drum, a charger and a developer tank around said drum, a heater for heating said drum, a drum temperature sensor for measuring drum temperature, and biasing means for applying a bias voltage to said developer tank for adjusting image density, the improvement wherein said electrophotographic apparatus further comprises, an ambient temperature sensor for measuring ambient temperature, heater controlling means for controlling said heater such that said drum temperature is higher than the ambient temperature measured by said ambient temperature sensor by about 5° C. to 27° C., selecting means for determining an optimum bias voltage to be applied to said developer tank according to said drum temperature, and bias controlling means for controlling said biasing means according to data obtained by said selecting means.

7. In an electrophotographic apparatus comprising a photosensitive drum, a charger and a developer tank around said drum, a heater for heating said drum, a drum temperature sensor for measuring drum temperature, and brightness adjusting means for adjusting lighting condition of said photosensitive drum, the improvement wherein said electrophotographic apparatus further comprises an ambient temperature sensor for measuring ambient temperature, heater controlling means for controlling said heater such that said drum temperature is higher than the ambient temperature measured by, said ambient temperature sensor by about 5° C. to 27° C., selecting means for determining optimum lighting conditions corresponding to said drum temperature, and brightness controlling means for controlling said brightness adjusting means by a signal obtained by said selecting means.

8. In an electrophotographic apparatus comprising a photosensitive drum, a charger and a developer tank around said drum, a heater for heating said drum, and a drum temperature sensor for measuring drum temperature, the improvement wherein said electrophotographic apparatus further comprises an ambient temperature sensor for measuring ambient temperature, heater controlling means for controlling said heater such that said drum temperature is higher than the ambient temperature measured by said ambient temperature sensor by about 5° C. to 27° C., output selecting means for determining an optimum output of said charger according to said drum temperature, and output controlling means for controlling the output of said charger by a signal obtained by said output selecting means.

* * * * *